US005177928A

United States Patent [19]

Fricker

[11] Patent Number: 5,177,928

[45] Date of Patent: Jan. 12, 1993

[54] FLAT STEEL ANCHOR FOR A PRE-CAST CONCRETE COMPONENT

[76] Inventor: Siegfried Fricker, Wacholderweg 27, 7258 Heimsheim, Fed. Rep. of Germany

[21] Appl. No.: 839,571

[22] Filed: Feb. 19, 1992

[30] Foreign Application Priority Data

Feb. 21, 1991 [DE] Fed. Rep. of Germany ..... 4105337

[51] Int. Cl.[5] ..... E04B 1/38

[52] U.S. Cl. ..... 52/707; 52/712

[58] Field of Search ..... 52/684, 689, 677, 707, 52/712, 685, 686, 687, 688, 689, 714

[56] References Cited

U.S. PATENT DOCUMENTS

| | | | |
|---|---|---|---|
| 1,917,529 | 7/1933 | Lampert | 52/689 |
| 2,291,157 | 7/1942 | Hillberg | 52/689 |
| 3,623,289 | 11/1971 | Lowery | 52/677 |
| 3,673,753 | 7/1972 | Anderson | 52/685 |
| 3,788,025 | 1/1974 | Holmes | 52/685 |
| 4,580,378 | 4/1986 | Kelly et al. | 52/707 |
| 4,831,803 | 5/1989 | Leonardis | 52/687 |
| 4,835,933 | 6/1989 | Yung | 52/689 |
| 5,042,219 | 8/1991 | Fricker . | |

*Primary Examiner*—David A. Scherbel
*Assistant Examiner*—Michele A. Van Patten
*Attorney, Agent, or Firm*—Robert W. Becker & Associates

[57] ABSTRACT

A flat steel anchor for a pre-cast concrete component is comprised of an anchoring portion to be positioned within the concrete component and a connecting portion protruding from the concrete component. The anchoring portion has lateral bars that enclose therebetween a first opening with a first opening cross-section in a plane of the flat steel anchor. The lateral bars are oppositely bent relative to one another and relative to the plane of the flat steel anchor. The respective outer curved planes of the lateral bars form anchoring surfaces of the anchoring portion. The first opening has a second opening cross-section in a plane perpendicular to the plane of the flat steel anchor defined by respective inner curvatures of the lateral bars. The connecting portion has a second opening for receiving a lifting device.

11 Claims, 6 Drawing Sheets

FLAT STEEL ANCHOR FOR A PRE-CAST CONCRETE COMPONENT

BACKGROUND OF THE INVENTION

The present invention relates to a flat steel anchor for a pre-cast concrete component having an anchoring portion to be positioned within the concrete component and a connecting portion protruding from the concrete component.

A flat steel anchor of the aforementioned kind is, for example, known from U.S. Pat. No. 5,042,219. In this embodiment, the flat steel anchor is provided with at least two sections within the anchoring portion which are hook-shaped and bent in opposite directions relative to one another. Viewed in the longitudinal direction of a reinforcement bar to be inserted, the two hook-shaped sections form essentially a closed shape. The known anchor provides sufficiently large anchoring surfaces for the concrete and also a good connection with the reinforcement bar, however, the orientation of the flat steel anchor always depends on the direction in which the reinforcement bar extends.

It is therefore an object of the present invention to provide a flat steel anchor of the aforementioned kind which may be produced in a less expensive and simpler manner. Furthermore, in a preferred embodiment of the flat steel anchor the orientation of the anchor should not be determined by the position of the reinforcement bars.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
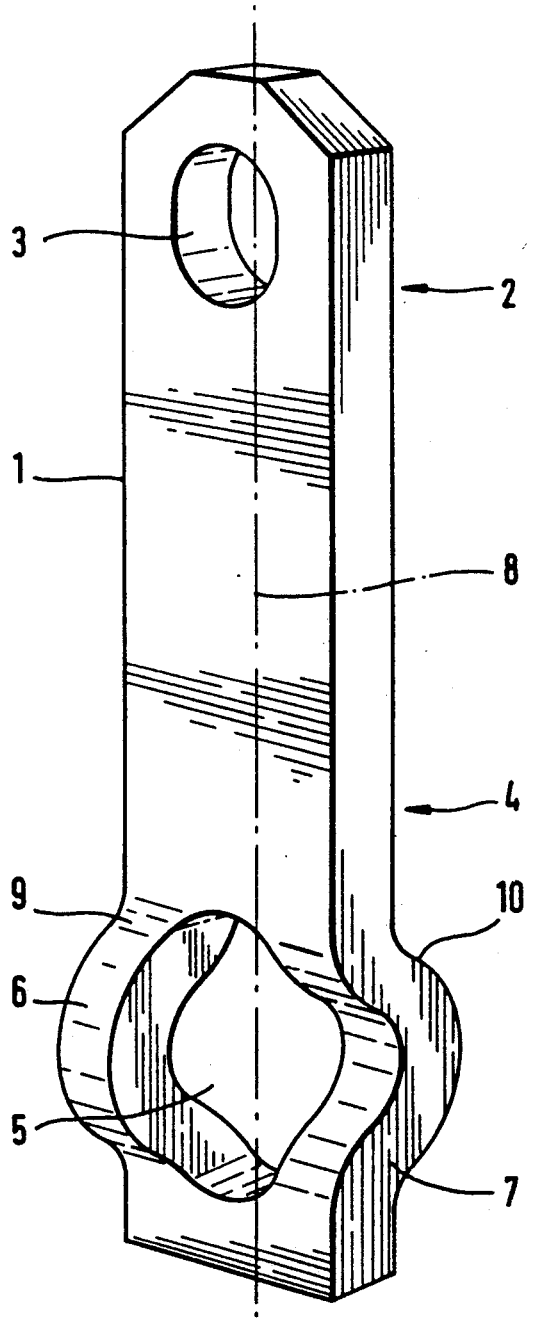
FIG. 1 is a perspective view of an inventive flat steel anchor.

The flat steel anchor of the present invention is primarily characterized by an anchoring portion to be positioned within the concrete component, the anchoring portion having lateral bars that enclose therebetween a first opening having a first opening cross-section in a plane of the flat steel anchor, the lateral bars being oppositely bent relative to one another and relative to the plane of the flat steel anchor with respective outer curved planes of the lateral bars forming anchoring surfaces of the anchoring portion, and with the first opening having a second opening cross-section in a plane perpendicular to the plane of the flat steel anchor defined by respective inner curvatures of the lateral bars; and a connecting portion protruding from the concrete component, when the anchoring portion is positioned within the concrete component, the connecting portion having a second opening for receiving a lifting device.

The essential advantages of the present invention are that the flat steel anchor, within its anchoring portion, forms a closed triangle of forces which may withstand extremely high loads. Furthermore, only very simple stamping steps need to be carried out in order to produce the anchor. Thus, a precise mass production with simple means is possible. It should also be mentioned that the inventive flat steel anchor may be used with or without reinforcement bars since the anchoring surfaces, within certain limits, may also transmit the anchoring forces. Furthermore, the arrangement or orientation of the flat steel anchor within the concrete component is entirely independent of the extension of the reinforcement bars if they are provided for the interaction with the flat steel anchor.

In order to uniformly distribute the load over the anchoring surfaces and evenly transmit the forces of the flat steel anchor into the concrete component, it is advantageous to bend the bars symmetrically with respect to the plane of the flat steel anchor. Preferably, the first opening is a stamped elongated hole having a longer dimension extending in a direction of a longitudinal axis of the flat steel anchor. Due to the elongated shape of the first opening the lateral bars have a corresponding length so that bending of the lateral bars is possible without creating too strong a tensile stress within the material.

In order to ensure a secure load distribution within the anchoring portion for a respective load, it is furthermore suggested in another embodiment of the present invention that the first distance between a free end of the anchoring portion and the first opening corresponds at least to a second distance between a free end of the connecting portion and the second opening. Furthermore, it is expedient that the first distance be greater than a width of the lateral bars.

Due to the inventive shape of the first opening within the anchoring portion of the flat steel anchor, it is possible to guide one or more reinforcement bars through the opening in any direction desired. To ensure that during the embedding into the concrete the flat steel anchor is securely held at a respective reinforcement bar extending in the plane of the flat steel anchor perpendicular to the height of the anchor, the second opening cross-section of the first opening should be embodied such that the flat steel anchor encloses the reinforcement bar in a form-locking manner. For the purpose of obtaining such a cross-section it is expedient that the second cross-section has a width which corresponds at least approximately to the height of the flat steel anchor. For the purpose of guiding a plurality of reinforcement bars through the common opening within the anchoring portion in a simple manner, it is suggested that the stamped elongated hole has a shorter dimension of a length of at least 0.3 times and at most 0.6 times the length of the longer dimension. Preferably, the shorter dimension has a length of at least 0.35 times and at most 0.5 times a length of the longer dimension. In this connection, it is suggested that the shorter dimension of the elongated hole is not substantially greater than the diameter of the reinforcement bars.

The first opening cross-section, corresponding to the plan view of the flat steel anchor, may be oval or elliptical. It is especially preferred that the opening, respectively, the first opening cross-section, in the plan view of the flat steel anchor has the form of a slotted hole having parallel lateral edges and end sections in the form of semicircles.

DESCRIPTION OF PREFERRED EMBODIMENTS

The present invention will now be described in detail with the aid of several specific embodiments utilizing FIGS. 1 through 7.

The flat steel anchor 1 represented in FIG. 1 is comprised of a connecting portion 2 having a second opening 3 for receiving a lifting device, which is not represented in the drawing. The flat steel anchor 1 further comprises an anchoring portion 4 which is, for example, embedded in a pre-cast concrete component The anchoring portion 4 is provided with a first opening 5 bordered by lateral bars 6 and 7. The lateral bars 6 and 7 extend parallel to a longitudinal axis 8 of the flat steel anchor 1. However, the lateral bars 6, 7 are bent relative to the plane of the flat steel anchor 1 in opposite directions, i.e., relative to the center plane of the flat steel anchor the lateral bar 6 is bent in a downward direction and the lateral bar 7 is bent in an upward direction. Due to this bending of the lateral bars 6, 7, the opening 5 has, besides a first cross-section in the plane of the flat steel anchor (flat extension) a second opening cross-section in a plane perpendicular to the first-mentioned plane of the flat steel anchor. Furthermore, the bending of the lateral bars 6 and 7 provides anchoring surfaces 9 and 10 for the concrete. The anchoring surfaces 9 and 10 are arranged symmetrically with respect to the longitudinal axis 8 and are therefore suited to evenly distribute forces under load.

Figure 2:
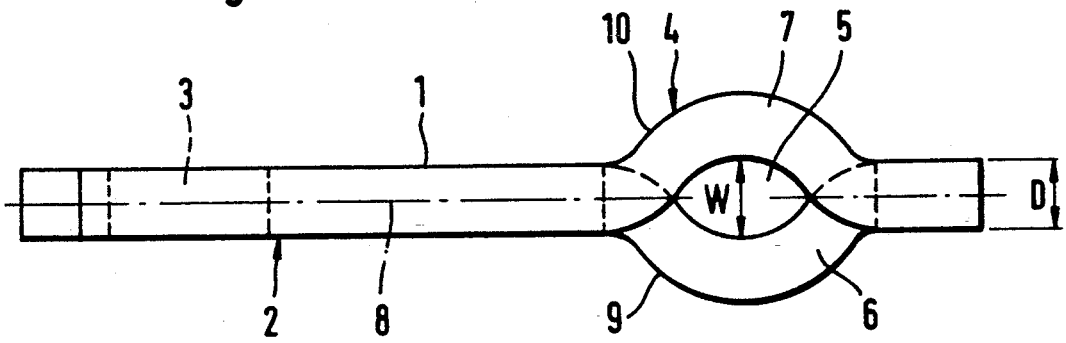
FIG. 2 is a side view of the flat steel anchor of FIG. 1.

FIG. 2 shows a side view of the flat steel anchor 1 with the connecting portion 2, the anchoring portion 4 and the first and second openings 3 and 5. From this side view, the opposite bending direction of the lateral bars 6 and 7 with their anchoring surfaces 9 and 10 is obvious. The opening 5, in the direction of the plane perpendicular to the first plane (flat extension) of the flat steel anchor, has a second opening cross-section with an inner width W which, in the example of FIG. 2, is slightly greater than the height D of the flat steel anchor. This second opening cross-section allows a reinforcement bar to be guided through the opening in a plane that is parallel to the plane (flat extension) of the flat steel anchor.

Figure 3A:
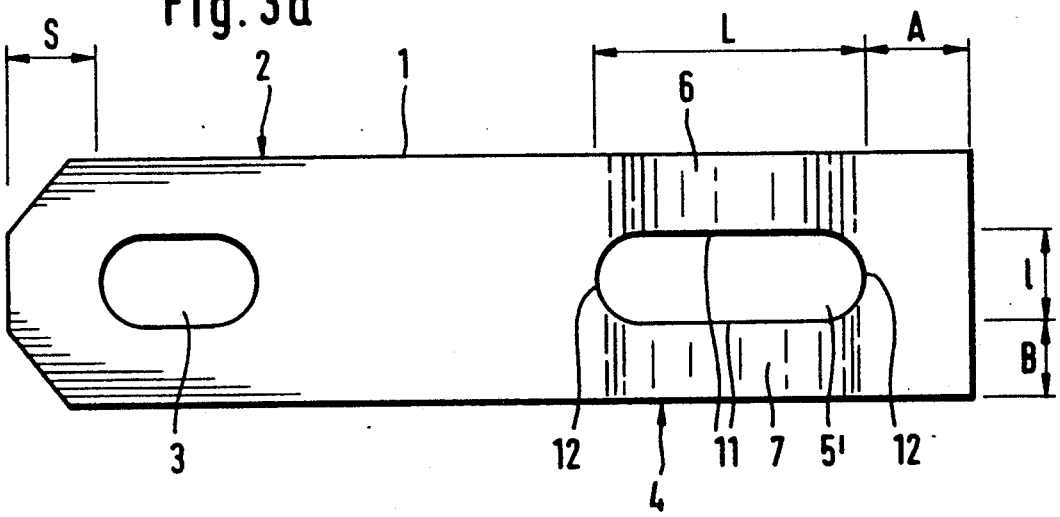
FIGS. 3*a*, 3*b* are respective plan views of an inventive flat steel anchor with varying openings within the anchoring portion.
Figure 3B:
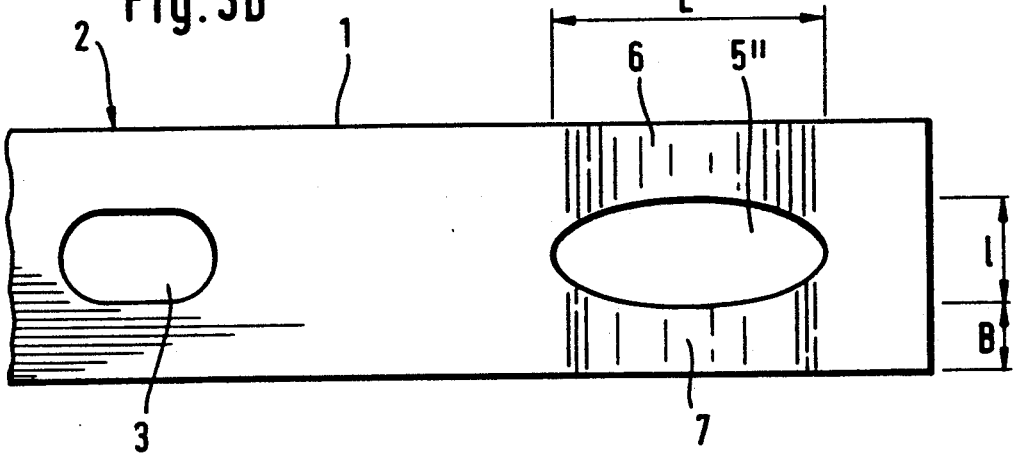

FIGS. 3*a* and 3*b* represent respectively a plan view of a flat steel anchor 1 whereby the flat steel anchor of FIG. 3*a* is provided with a slotted hole 51 with two parallel lateral edges 11 and end sections in the form of semicircles 12 and whereby the anchor of FIG. 3*b* is provided with an oval opening 5''. In the connecting portion 2 the opening 3, provided for receiving a hook or a similar means, is spaced a distance S from the free end of the flat steel anchor 1. The opening 5', respectively, 5'' is provided with a longer dimension that extends in the longitudinal direction of the flat steel anchor 1 and a shorter dimension which extends perpendicular to the first dimension 1. The length of the shorter dimension L in FIG. 3*a* corresponds to 0.35 times the length of the longer dimension L. The shorter dimension L in FIG. 3*b* corresponds to 0.5 times the length of the longer dimension L. The width of the lateral bars 6 and 7 is designated by the letter B. The distance A of the opening 5', respectively, 5'' from the free ends of the anchoring portion 4 should at least correspond to the distance S. In the embodiment shown, the distance A is slightly greater than the distance S.

Figure 4:
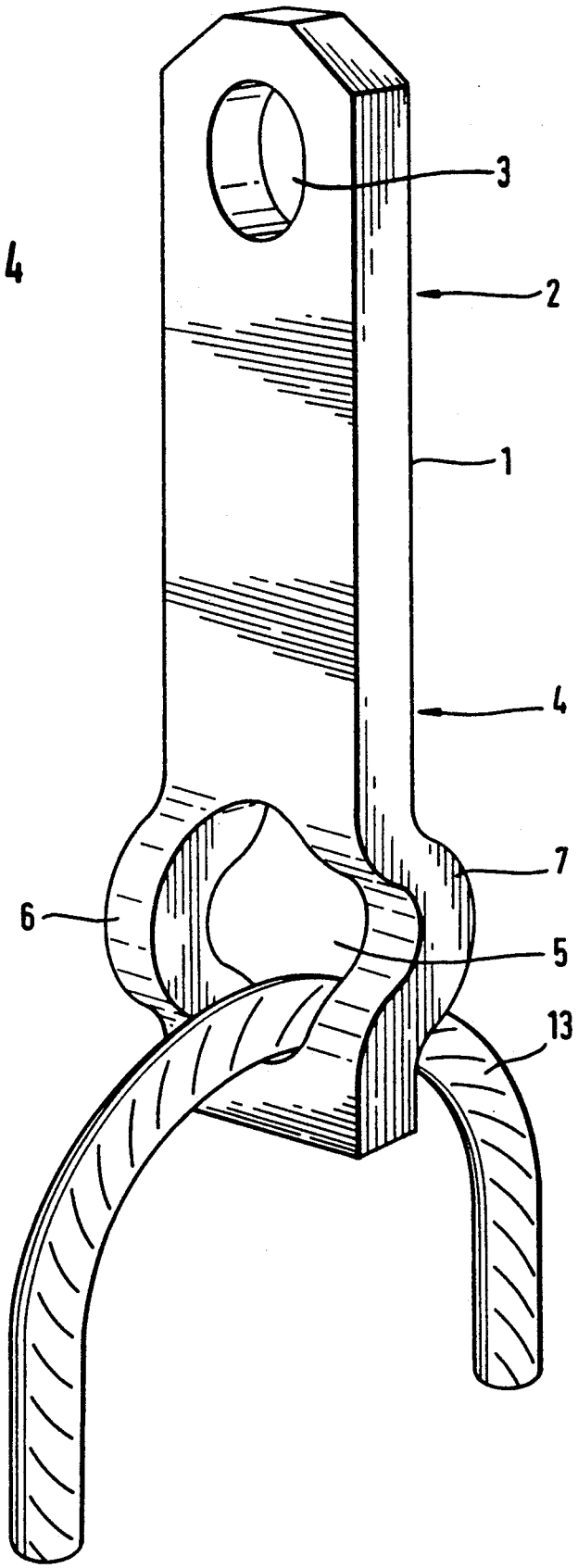
FIG. 4 shows a flat steel anchor according to FIG. 1 with a reinforcement bar guided through the opening.

FIG. 4 represents a flat steel anchor 1 in a perspective view according to FIG. 1, however, a reinforcement bar 13 is guided through the opening 5. Reference numerals in FIG. 4 which are identical to reference numerals in FIG. 1 correspond to identical parts.

Figure 5:
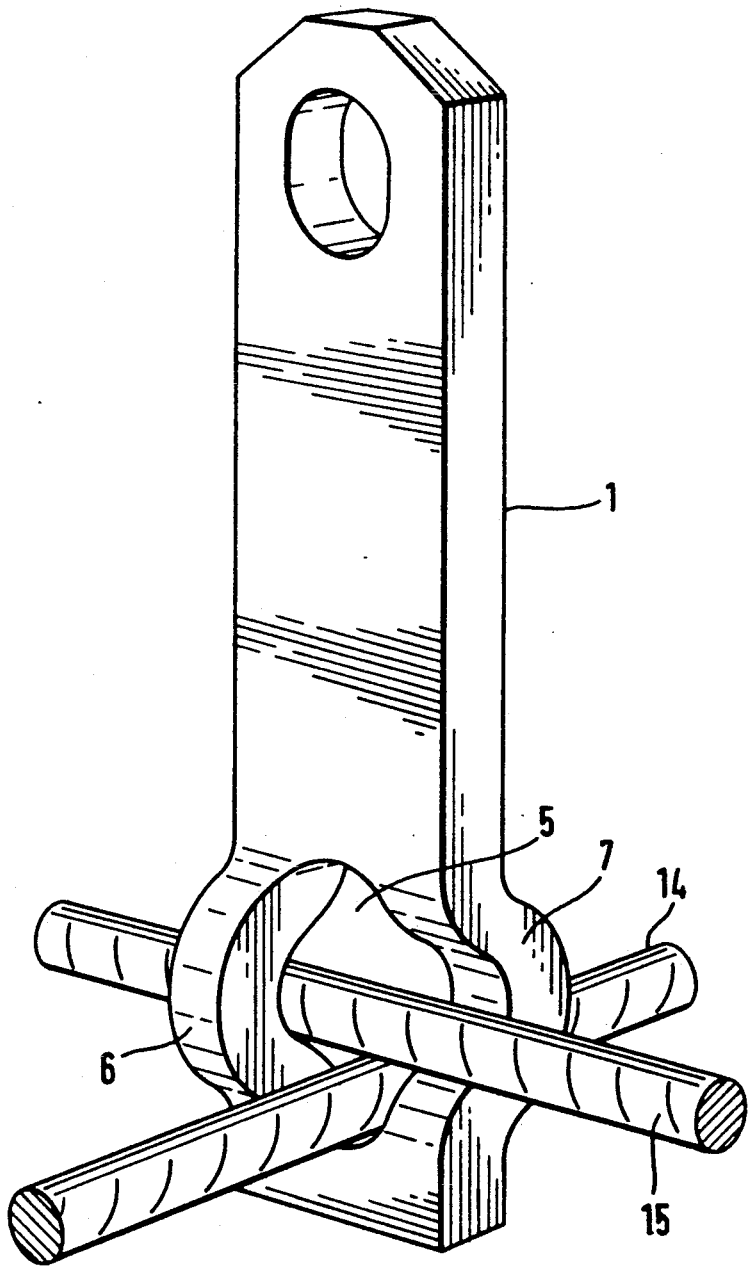
FIG. 5 shows an inventive flat steel anchor with two crossed reinforcement bars.

FIG. 5 shows a flat steel anchor 1 with two straight reinforcement bars 14 and 15 guided through the opening 5. The reinforcement bar 14 extends perpendicular to the plane (flat extension) of the flat steel anchor and the reinforcement bar 15 extends in the plane (flat extension) of the flat steel anchor whereby the reinforcement bar 15 rests within the bent portions of the lateral bars 6 and 7. Due to the crossed arrangement of the reinforcement bars 14 and 15, the flat steel anchor 1 is positioned during the embedding into the concrete such that an additional securing of its position is no longer required.

Figure 6:
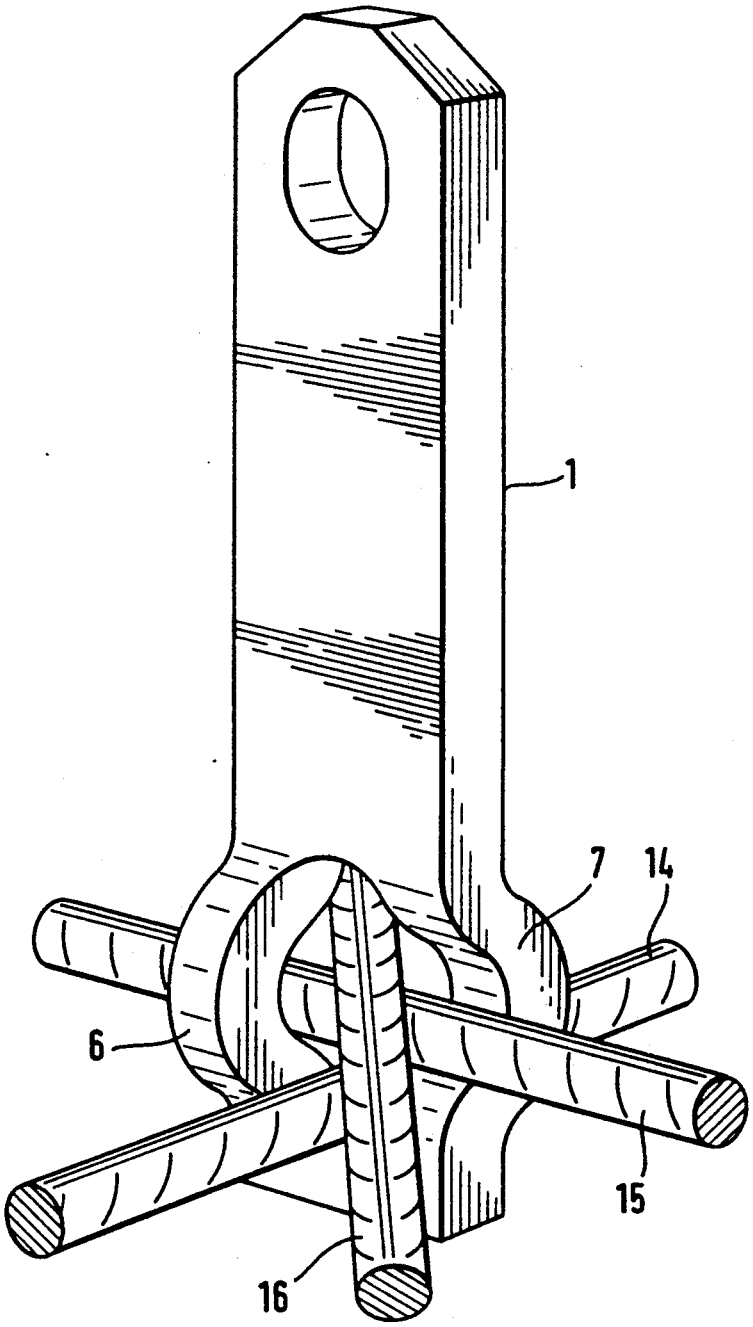
FIG. 6 shows a flat steel anchor of the present invention with three reinforcement bars arranged in different planes.

Finally, in a further embodiment according to FIG. 6, a third reinforcement bar 16 is provided. Due to this measure a more favorable force distribution within the pre-cast concrete component during lifting by a lifting device is achieved.

Figure 7:
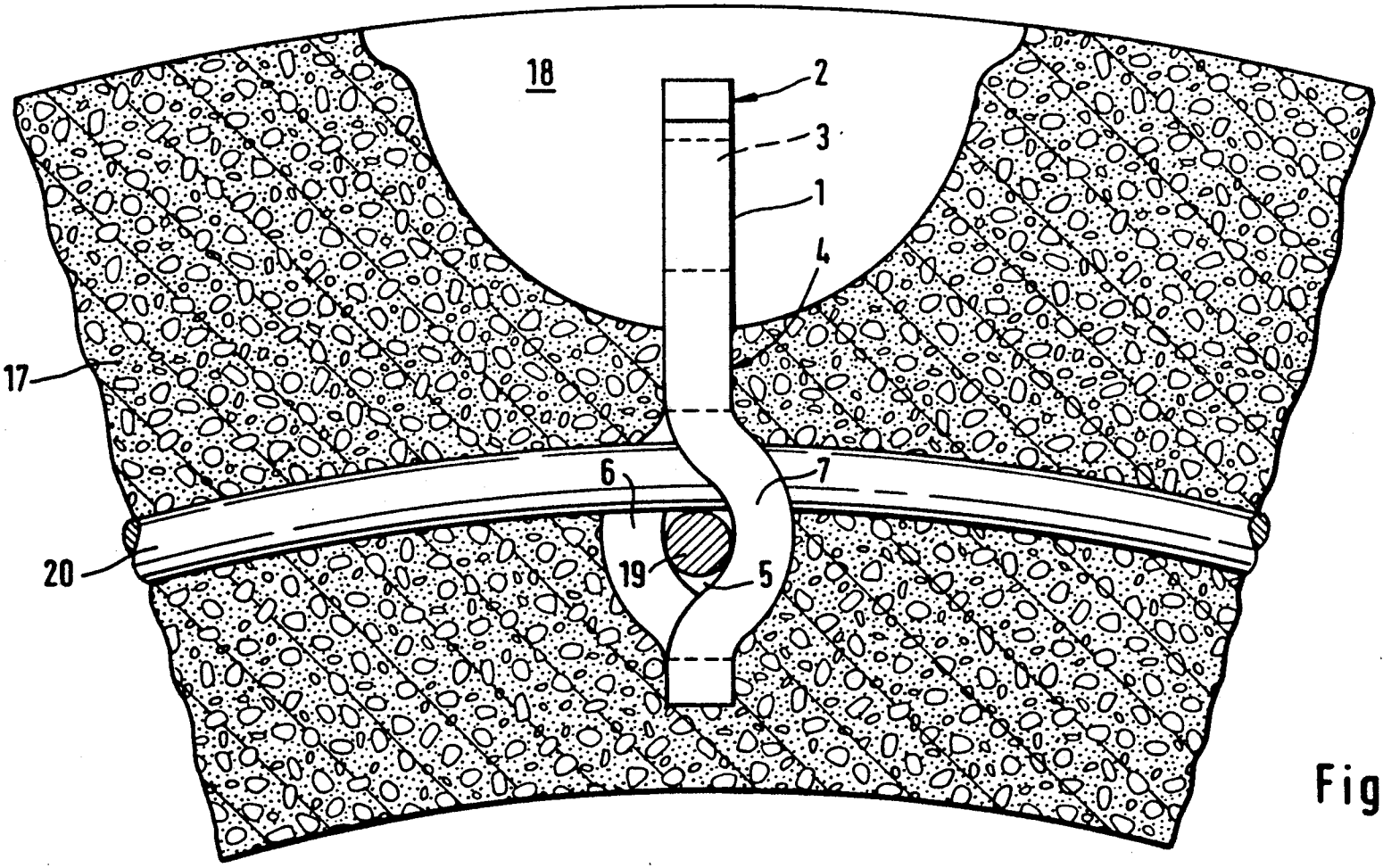
FIG. 7 shows a section of a concrete tube with an inventive flat steel anchor cast therein.

FIG. 7 shows a cross-sectional view of a section of a concrete tube with an embedded flat steel anchor 1. The connecting portion 2 protrudes from a semi-spherical depression 18 in the surface of the concrete tube 17 so that the second opening 3 within the connecting portion 2 is easily accessible. The anchoring portion 4 is embedded in the concrete tube and two reinforcement bars 19 and 20 extend through the opening 5 within the anchoring portion 4. The reinforcement bar 19 is arranged in the plane (flat extension) of the flat steel anchor and the reinforcement bar 20 extends in the form of an arc that corresponds to the curvature of the concrete tube 17 so that it penetrates the opening 5 at a right angle relative to the plane (flat extension) of the flat steel anchor 1.

The present invention is, of course, in no way restricted to the specific disclosure of the specification and drawings, but also encompasses any modifications within the scope of the appended claims.

What I claim is:

1. A flat steel anchor for a precast concrete component, said flat steel anchor comprising:

an anchoring portion to be positioned within the concrete component, said anchoring portion having lateral bars that enclose therebetween a first opening having a first opening cross-section in a plane of said flat steel anchor, said lateral bars being oppositely bent relative to one another and relative to said plane of said flat steel anchor, with respective outer curved planes of said lateral bars forming anchoring surfaces of said anchoring portion, and with said first opening having a second opening cross-section in a plane perpendicular to said plane of said flat steel anchor defined by respective inner curvatures of said lateral bars; and a connecting portion protruding from the concrete component, when said anchoring portion is positioned within the concrete component, said connecting portion having a second opening for receiving a lifting device.

2. A flat steel anchor according to claim 1, wherein said lateral bars are symmetrically bent with respect to said plane of said flat steel anchor.

3. A flat steel anchor according to claim 1, wherein said first opening is a stamped elongated hole having a longer dimension extending in a direction of a longitudinal axis of said flat steel anchor.

4. A flat steel anchor according to claim 3, wherein said stamped elongated hole has a shorter dimension having a length of at least 0.3 times and at most 0.6 times a length of said longer dimension.

5. A flat steel anchor according to claim 4, wherein said shorter dimension has a length of at least 0.35 times and at most 0.5 times a length of said longer dimension

6. A flat steel anchor according to claim 1, wherein a first distance between a free end of said anchoring portion and said first opening corresponds at least to a second distance between a free end of said connecting portion and said second opening.

7. A flat steel anchor according to claim 6, wherein said first distance is greater than a width of said lateral bars.

8. A flat steel anchor according to claim 1, wherein said second opening cross-section has a width corresponding at least approximately to a height of said flat steel anchor.

9. A flat steel anchor according to claim 1, wherein said first opening cross-section is elliptical.

10. A flat steel anchor according to claim 1, wherein said first opening cross-section is oval.

11. A flat steel anchor according to claim 1, wherein said first opening cross-section is in the form of a slotted hole having parallel lateral edges and end sections in the form of semicircles.

* * * * *